United States Patent [19]

Conrad et al.

[11] Patent Number: 4,635,585

[45] Date of Patent: Jan. 13, 1987

[54] SYSTEM FOR SPRAY COATING SUBSTRATES

[75] Inventors: Douglas J. Conrad, Lorain; James L. Kennon, Amherst; Lawrence J. Macartney, Lorain; Donald R. Scharf, Amherst, all of Ohio

[73] Assignee: Nordson Corporation, Amherst, Ohio

[21] Appl. No.: 787,080

[22] Filed: Oct. 15, 1985

[51] Int. Cl.[4] ..... B05B 15/12

[52] U.S. Cl. ..... 118/316; 118/325; 118/326

[58] Field of Search ..... 118/316, 325, 326

[56] References Cited

U.S. PATENT DOCUMENTS

| | | | |
|---|---|---|---|
| 1,529,134 | 3/1925 | Kelter | 118/326 X |
| 1,553,133 | 9/1925 | Bowman et al. . | |
| 1,659,179 | 2/1928 | Wilson | 118/325 X |
| 2,210,187 | 8/1940 | Ross | 91/60 |
| 2,247,963 | 7/1941 | Ransburg et al. | 91/45 |
| 2,425,652 | 8/1947 | Starkey | 117/17 |
| 2,528,087 | 10/1950 | Schoepe | 91/45 |
| 3,513,808 | 5/1970 | Mortimer et al. | 118/9 |
| 3,902,453 | 9/1975 | Frische | 118/322 |
| 3,989,001 | 11/1976 | Brigham et al. | 118/7 |
| 4,009,301 | 2/1977 | Heckman | 118/324 |
| 4,099,486 | 7/1978 | Bialorucki et al. | 118/635 |
| 4,538,542 | 9/1985 | Kennon et al. | 118/302 |

FOREIGN PATENT DOCUMENTS

| | | | |
|---|---|---|---|
| 2067927 | 8/1981 | United Kingdom | 118/325 |

*Primary Examiner*—Shrive P. Beck

*Attorney, Agent, or Firm*—Wood, Herron & Evans

[57] ABSTRACT

A system for spray coating a substrate such as a flexible web of plastic film with a gas barrier coating containing a polymer dispersion. The system includes a spray coating booth or chamber including spray nozzles dispensing a spray of coating material onto the surface of a web of material continuously moving into and out of the coating chamber. A series of feed rollers move the web into the coating booth into proximity to the spray nozzles such that on actuation of the nozzles a stream of coating material coats both sides of the surface of the web with a wet coating layer. The coating booth includes a system for containing and removing the airborne liquid overspray carried from the booth with the web without disturbing the wet coating on the web and without substantially drawing of overspray from the coating chamber.

7 Claims, 2 Drawing Figures

SYSTEM FOR SPRAY COATING SUBSTRATES

BACKGROUND OF THE INVENTION

This invention relates to a system for spray coating substrates such as a continuously moving web of plastic film with a coating material to form on drying a film on the substrate. For example, this invention is applicable to providing plastic materials such as polyethylene film used in the packaging industry with a coating of a copolymer of vinylidene chloride (commonly referred to as "PVDC") to provide the polyethylene film with a gas barrier coating to prevent the migration of gas such as air through the plastic film. The process provides initially a wet uniform coating on the substrate which coating is then dried completely coalescing the material into a polymer film.

In spray coating of such substrates, it is necessary to continuously deliver aqueous coating material to the spray nozzles for the coating of the substrate continuously passing through the spray coating booth and to control the airborne aqueous overspray to prevent its release to the atmosphere while containing the polymer particles, particularly without disturbing the liquid coating on the substrate or the spray pattern in the coating chamber.

SUMMARY OF THE INVENTION

The coating system of this invention includes a spray coater for receiving a continuously moving web of material of indeterminate length, for example, a roll of sheet polyethylene, and a transport system for moving the material into and through the coater. The spray coating chamber in a presently preferred form of the invention is a vertical coater having opposed banks of vertically disposed spray nozzles. The continuously moving web to be coated is conveyed generally downwardly from a horizontal axis into the coater, turned to a vertical orientation and passed between the opposed banks of spray nozzles. Airless spray nozzles may be used. A set of nozzles in each of the banks of spray nozzles operate simultaneously to coat both sides of the film. The film being coated passes in close proximity to the airless spray nozzles through which is passed the wet coating material such that the surface of the film is impacted with a stream of coating material to provide it with a wet coating layer. The transport system then carries the coated substrate vertically upward and out of the spray coating booth for subsequent processing which may include drying to remove the water from the coating to coalesce the film-forming particles of the coating on the substrate.

The spray coater includes an overspray control system for both containing the airborne liquid overspray within the booth and for recovering the film-forming particles of the coating in a substantially dry form. To this end, the coater includes an outlet of extended length having a bottom open end communicating with the coating chamber and having a top end open to the environment. The top opening is larger than the bottom opening. A conduit and duct system is provided having open ends communicating with the interior of the outlet and opposite open ends likewise communicating with the ambient environment. This conduit and duct system is in turn connected to a filter which may include an internal fan for drawing air through the conduit and duct means and the filter. On operation of the system, a suction is created in the duct drawing ambient air down through the top opening of the outlet through the interior of the outlet and into the duct. Because the top outlet opening is larger than the bottom, more air is drawn through the top opening than through the bottom. Thus, liquid overspray in the outlet is drawn toward the filter without any substantial drawing of overspray out of the spray coating chamber. Ambient air also enters the duct through its open ends. The amount of ambient air entering the duct through its open ends is controlled together with the speed of the fan motor to insure that the spray within the spray chamber is not disturbed by external suction forces while at the same time overspray is prevented from escaping out of the top of the chamber. Moreover, the position of the filter and conduit are such in relation to the air flow that the film-forming particles contained in the overspray are substantially dried before reaching the filter. The substrate leaving the coating chamber does not touch any portion of the outlet which would otherwise disturb the wet coating. Rather, it is enveloped with a flow of incoming air through the top opening of the outlet.

DETAILED DESCRIPTION OF THE INVENTION

Figure 1:
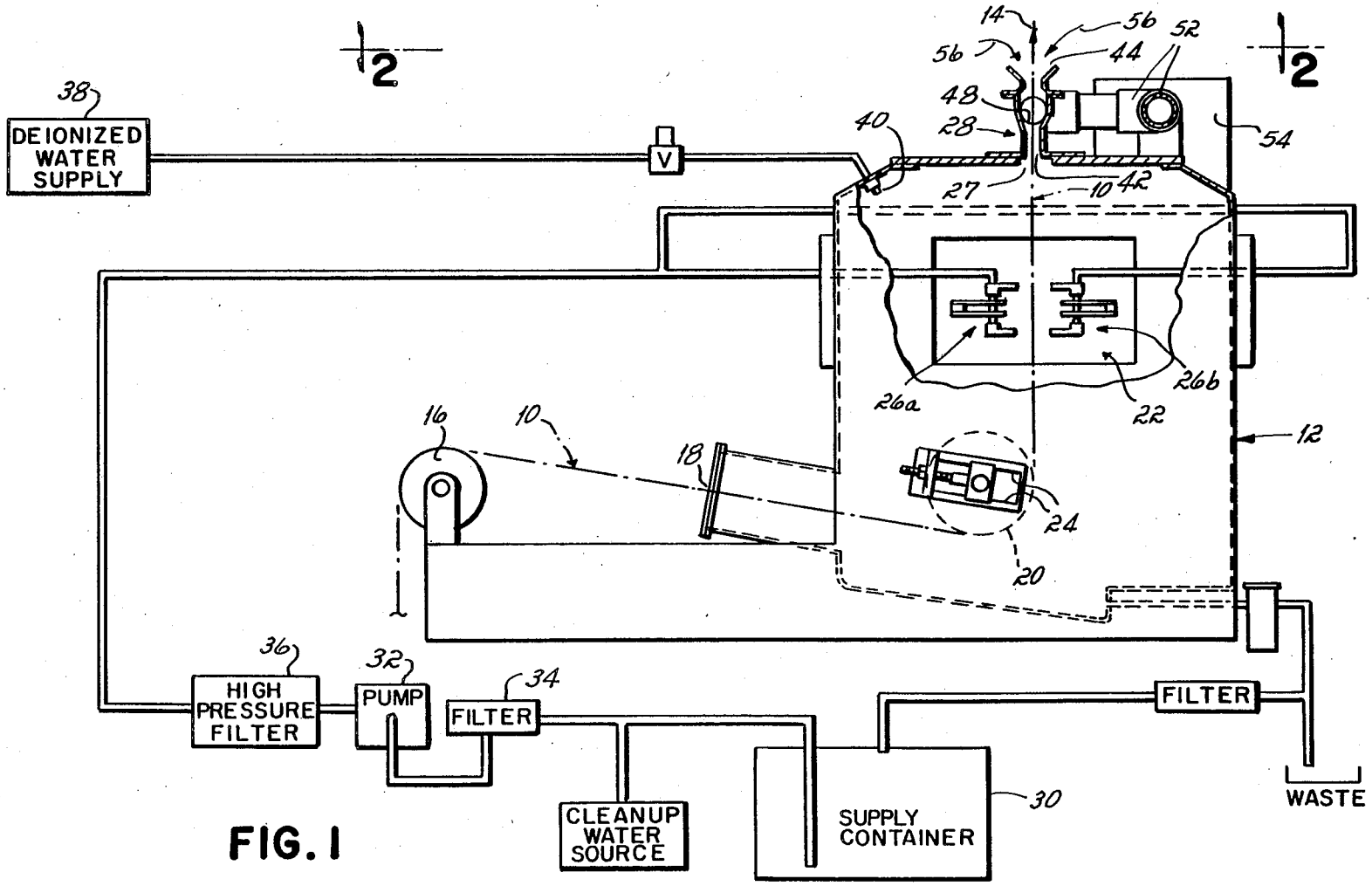
FIG. 1 is a schematic illustration of the system for coating a continuously moving web of material according to the present invention.

FIG. 1 shows diagrammatically the system of the present invention for coating of a continuously moving web of material 10 wherein the material 10 is conveyed into a coater 12 for impact spraying of a liquid dispersion coating thereon, and then conveyed out of the coater for further processing such as to an oven (not shown) where the coating layer formed on the substrate is dried to remove the water from the coating and to form a thin film.

The material to be coated may be a web of material of indeterminate length rolled on a supply roller (not shown) located a suitable distance with respect to the coater. A roller (not shown) downstream of the coater pulls the film off the supply roller and through the coater in the direction shown by the arrow 14 in FIG. 1. Material 10 is drawn off the supply roller and passes over a steering roller 16 and into the spray coater through an inlet opening 18. The opening 18 has a cross-sectional configuration corresponding to the shape of the substrate being coated. Upper and lower flaps of flexible material such as rubber or plastic may be provided for sealing the inlet opening 18 while permitting the material to be drawn therethrough. The opening can be provided with removable masks of various cross-sectional shapes corresponding to a particular product being coated which may be inserted and removed to correspond to the shape of the material. For example, when a sheet of material is being coated, the opening is in a substantially rectangular form such as that shown in FIG. 2. If a tubular piece of material were being coated, an insert having a circular cross-section could be used instead.

The material 10 enters the booth 12 at an angle which is downwardly inclined with respect to the horizontal and passes over an idler roller 20 which changes its orientation to a generally vertical upward direction.

This structure ensures that any dripping from the spray area 22 is deposited within and contained within the coater 12. The idler roller 20 may be supported on a series of tracks 24 outside of the coater which run parallel to the angle of entry of the material through the inlet so that the position of the roller 20 can be changed to adjust the position of the substrate with respect to the outlet opening 27 of the spray chamber 12 such that the material being coated passes through that outlet without touching the sides thereof. Bellows type seals (not shown) at the opposed ends of the roller shaft permit movement of the idler roller 20 in the chamber on the tracks 24 while containing overspray of material within the coater 12.

Two banks of spray nozzles 26a, 26b are mounted above the idler roller 20 and are so oriented that the substrate 10 passes therebetween. Each of the nozzle assemblies includes sufficient spray nozzles to fully coat the substrate across its width. Suitable nozzles are airless spray nozzles, Part No. 713201 manufactured by Nordson Corporation of Amherst, Ohio. The nozzles are movable so that they may be oriented with respect to the substrate being coated to obtain full surface coating thereof. For example, when coating a sheet material as shown in FIG. 1, a series of nozzles are spaced across the width of the material to achieve full widthwise coverage. With impact spray coating, the material surface to nozzle distance is preferably relatively small, e.g., on the order of 2½ inches when spraying a coating material such as W. R. Grace 820 PVDC emulsion at a pressure of about 650 psig.

After the material has been spray coated in the coating chamber, it passes out of the chamber through the opening 27 in the chamber wall and through an outlet 28 of extended length mounted thereto. The coated material still wet from the liquid coating does not touch any of these surfaces as it passes therethrough which would otherwise wipe the coating from the surface. The material then passes to a subsequent stage for subsequent processing such as a drying stage to remove the water to completely coalesce the coating on the substrate. The material may then be further processed or taken up on a take-up roller.

Spray coating material is provided to the bank of nozzles 26a, 26b from a supply container 30. The details of a suitable fluid flow system for providing material to the banks of spray nozzles as well as for purging the system with water or a cleaning solution is shown and described in U.S. Pat. No. 4,538,542, assigned to the assignee of this invention, and that disclosure is incorporated herein by reference. Briefly stated, material from a supply container 30 is pumped by means of a pump 32 through a first and second filter 34, 36 to the banks of spray nozzles 26a, 26b. Suitable valves (not shown) are provided for controlling the flow of material thereto. A clean-up water source is also provided for flushing of the circuit to permit cleaning of the system.

In spray coating some PVDC materials, it is sometimes necessary to increase the humidity in the coating chamber to prevent the premature drying of the PVDC material. To this end, provision is made for supplying deionized water from a supply source 38 to a misting nozzle 40 within the chamber operative to provide a mist of deionized water in the chamber thereby increasing chamber humidity.

Figure 2:
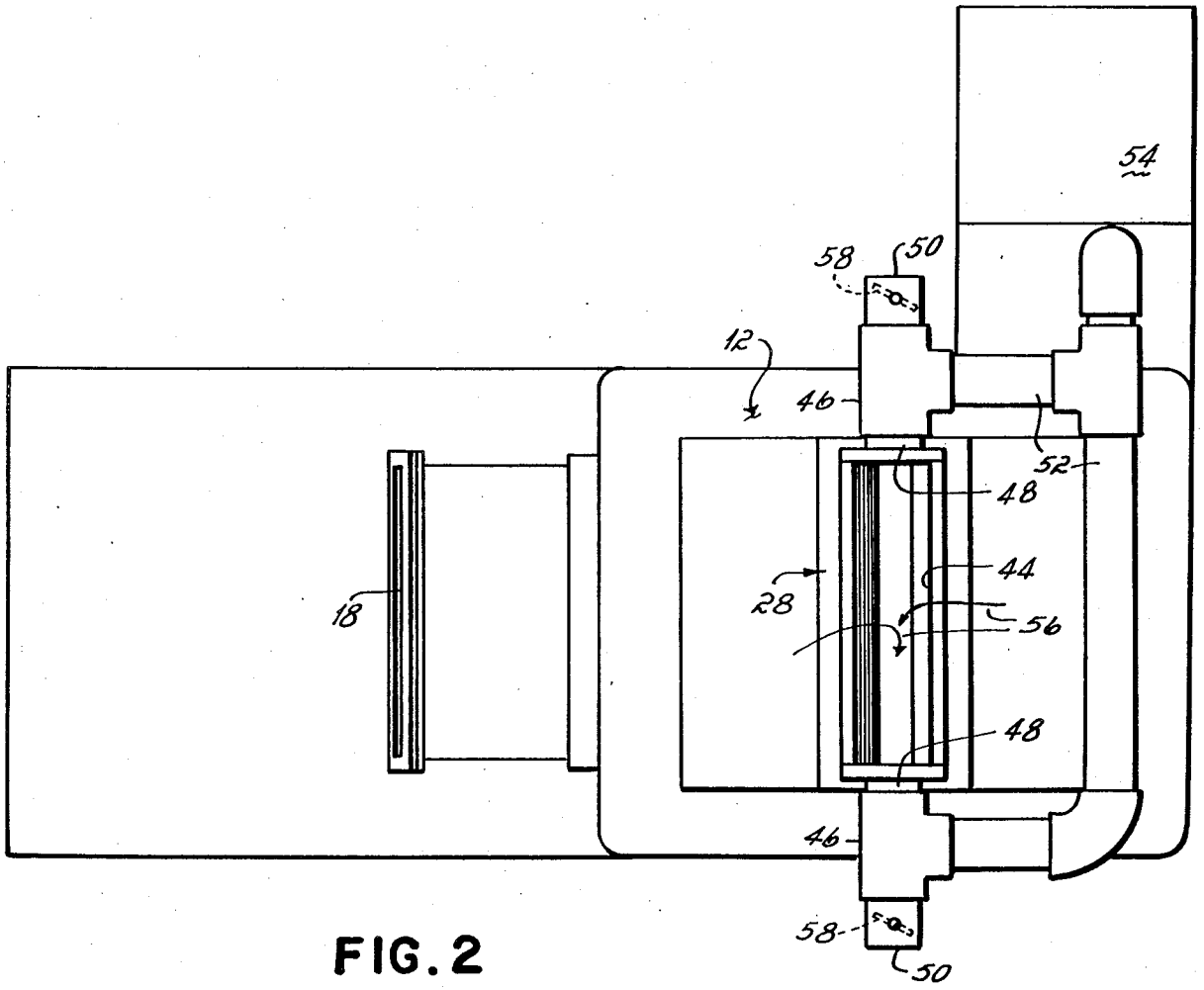
FIG. 2 is a view taken along line 2—2 of FIG. 1.

Referring now in addition to FIG. 2, the outlet 28 of the chamber 12 is of extended vertical dimension. It has a first or bottom open end 42 communicating with the opening 27 in the chamber 12 and a second or top open end 44 communicating with the ambient environment. The shape of the outlet again generally corresponds to the shape of the material being coated. That is, as shown in FIGS. 1 and 2, a web of sheet material is being coated thus the outlet has an extended width but a relatively narrow opening. The opening is large enough, however, to prevent the sides thereof coming into contact with the material passing therethrough. In the same manner as the inlet, the outlet can be provided with masks of various cross-sectional configuration to closely conform to the configuration of the material being coated.

Referring in particular to FIG. 2, a duct 46 has a pair of open ends 48 communicating with the interior of the outlet 28 and a pair of opposed open ends 50 communicating with the environment. The duct 46 is connected by means of a conduit 52 to a dust collector 54. An example of a suitable dust collector is a Torit Model 64 cabinet dust collector which has a plurality of fabric filters to trap dust particles of micron or greater size. An American Air Filter dust collector sold under the name Arrestall, Size No. 400 can also be used.

The dust collector has an internal fan (not shown) which pulls ambient air through the openings 50 of the duct and also through the top opening 44 of the outlet 28 and through the ends 48 and then through the conduit 52 and into the dust collector. Wet overspray within the outlet 28 is caught in this air flow as it passes upwardly with the substrate through the chamber outlet opening 27. This wet overspray as it travels through the duct and conduit is dried by the air to a powder of flour-like consistency which is trapped in the dust collector and then can be readily disposed of.

As stated, the top opening 44 of the outlet 28 is larger than the bottom 42. This provides for a greater flow of air into the outlet through the top opening than the bottom (as shown by arrows 56 in FIG. 1). As a result, more air is drawn into the outlet 28 through the top 44 than the bottom 42 thus preventing the suction of the overspray collection system from drawing substantial spray coating material out of the spray coating chamber. Thus, the spray environment within the chamber is not disturbed by these external suction forces while at the same time overspray is prevented from escaping out of the top 44 of the outlet 28.

Butterfly valves 58 are located in the ends 50 of the ducts and are set to control the amount of air which comes in through the ends 50 in relation to that entering the top opening 44 of the outlet 28. The positions of the valves are controlled together with the speed of the fan motor to optimize the flow of air through the system such that spray material is not drawn out of the chamber.

Thus having described the invention, what is claimed is:

1. A system for spray coating a substrate with a liquid coating material containing particles of a film-forming material in a liquid vehicle, said system comprising, in combination, a coater having an inlet and an outlet and including a coating chamber portion for receiving the substrate to be coated, said outlet having a first open end communicating with said chamber and a second open end communicating with the ambient environment, said second end opening being larger than said first end opening, spray nozzle means in said chamber for dispensing said spray of said liquid coating material onto said substrate, transport means for moving said substrate into said coater through said inlet, into said coating chamber portion into proximity to said spray nozzle means for coating by said spray nozzle means, and out of said coating chamber through said outlet, overspray control means for containing and conveying the airborne overspray from said coating chamber, said overspray control means comprising a particle collector for collecting the particles of film-forming material in said overspray, duct means communicating at one end with the interior of said coater outlet and at the other with the ambient environment, conduit means connected to said particle collector and in fluid communication with said duct means, and air flow control means for drawing ambient air through said second open end of said outlet and through said other end of said duct means at a rate such that airborne overspray in said outlet is drawn into said duct means and transported to said particle collector without drawing substantial spray material out of said coating chamber.

2. The system of claim 1 wherein said coater is a vertical coater, said substrate passing through said coating chamber portion in a vertically upward direction and leaving said coating chamber through the top of the coater, said outlet having a shape of the silhouette of the substrate being coated permitting the substrate to pass therethrough to exit the top of the coating chamber without touching the side walls thereof, and wherein said means for drawing the airborne overspray from said chamber causes drying of said overspray in said duct and conduit means between said outlet and said particle collector.

3. The system of claim 1 wherein said overspray control means includes valves in the end of said duct means open to the ambient environment for controlling the flow of air therethrough.

4. The system of claim 1 wherein said substrate enters said coating chamber at an angle downwardly inclined to the horizontal, is thereafter turned to a vertically upward direction, and passes vertically between opposed banks of spray nozzles.

5. The system of claim 1 further comprising a mask over the inlet and outlet in the shape of the silhouette of the substrate to be coated permitting its entrance to and exit from the coating chamber while limiting escape of the airborne overspray therethrough.

6. The system of claim 1 further comprising means for introducing a controlled amount of moisture into said coating chamber to control the humidity level in said coating chamber portion.

7. A system for spray coating a substrate with a liquid coating material containing particles of a film-forming material in a liquid vehicle, said system comprising, in combination, an enclosed coater including an inlet, an outlet and a coating chamber portion for continuously receiving a substrate of indeterminate length to be coated, said substrate moving into said coater through said inlet in a direction downwardly inclined to the horizontal and vertically upward into said coating chamber portion to be coated and vertically upwardly out of the coating chamber after spray coating, said outlet being of extended length and having a first open end communicating with said chamber and a second open end communicating with the ambient environment, said second end opening being larger than said first end opening, spray nozzle means in said coating chamber portion for dispensing a spray of said liquid coating material onto all external surfaces of said substrate, means for locating said substrate to be coated in proximity to said spray nozzle means such that on actuation of said spray nozzle means said stream of liquid coating material impacts on the surfaces of the substrate to be coated, transport means for moving said substrate into said coater through said inlet, into said coating chamber portion into proximity to said spray nozzle means for coating by said spray nozzle means, and out said coating chamber through said outlet, overspray control means for containing and conveying the airborne overspray from said coating chamber, said overspray control means comprising a particle collector for collecting the particles of film-forming material in said overspray, a pair of ducts each communicating at one end with the interior of the coater outlet and at the other with the ambient environment, valves located in each said ends of said ducts communicating with the ambient environment, a conduit connecting said particle collector to said ducts, said outlet having a shape corresponding to the silhouette of the substrate being coated permitting the substrate to pass therethrough to exit the top of the coating chamber, means for drawing airborne overspray from said outlet to said particle collector and being operative to draw ambient air through the top of said outlet and through the ends of the ducts open to the ambient environment such that airborne overspray in said outlet is drawn into said ducts and transported to said particle collector without drawing substantial spray material out of said coating chamber, the air flow through said ducts and conduit being sufficient such that said particles of film-forming material are substantially dry on reaching said collector.

* * * * *